US005328042A

United States Patent [19]

Heise

[11] Patent Number: 5,328,042

[45] Date of Patent: Jul. 12, 1994

[54] FLAT STORABLE CONTAINER

[75] Inventor: Jeff H. Heise, Wheaton, Ill.

[73] Assignee: Ockerlund Industries Inc., Forest Park, Ill.

[21] Appl. No.: 64,957

[22] Filed: May 20, 1993

[51] Int. Cl.[5] ..... B65D 5/02

[52] U.S. Cl. ..... 220/7; 220/4.28; 220/4.29; 220/648; 220/6

[58] Field of Search ..... 229/23 R, 125.22; 220/7, 6, 4.28, 4.29, 1.5, 648, 646; 217/13, 45, 48, 56

[56] References Cited

U.S. PATENT DOCUMENTS

| | | | |
|---|---|---|---|
| 3,578,050 | 5/1971 | Weingarten | 220/6 |
| 4,101,052 | 7/1978 | Dove | 229/125.22 |
| 4,589,588 | 5/1986 | Swanhart | 220/7 |
| 4,693,411 | 9/1987 | Snyder | 229/23 R |
| 4,860,912 | 8/1989 | Kupersmit | 229/23 R |
| 4,893,746 | 1/1990 | Swanhart et al. | 229/23 R |

FOREIGN PATENT DOCUMENTS

| | | | |
|---|---|---|---|
| 260077 | 9/1928 | Italy | 229/125.22 |

*Primary Examiner*—Stephen Castellano
*Attorney, Agent, or Firm*—Gerstman, Ellis & McMillin, Ltd.

[57] ABSTRACT

A flat-storable container comprises a bottom deck and a pair of opposed sidewalls attached to the bottom deck in hinged relation thereto, to permit the sidewalls to lie flat against the deck in a folded position, and to stand in perpendicular relation thereto in a container-forming position. The sidewalls each typically carry a pair of opposed, foldable side flaps which are proportioned to be unfolded in the container-forming position to form lateral walls between the sidewalls. Thus, sets of the engaging side flaps define lateral container walls extending between ends of the opposed sidewalls, to define with the deck an open-top, rectangular container. A container lid is typically provided, plus straps for holding the lid on the container and for holding engaging side flaps together, when engaging side flaps are used. Alternatively each lateral wall may be defined by a single side flap. Such containers may be of relatively large size, and used in airliner baggage compartments or any other desired use.

16 Claims, 3 Drawing Sheets

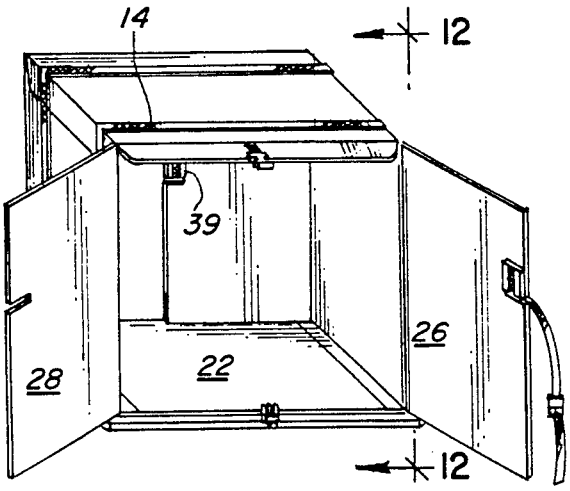
FIG. 10
FIG. 11
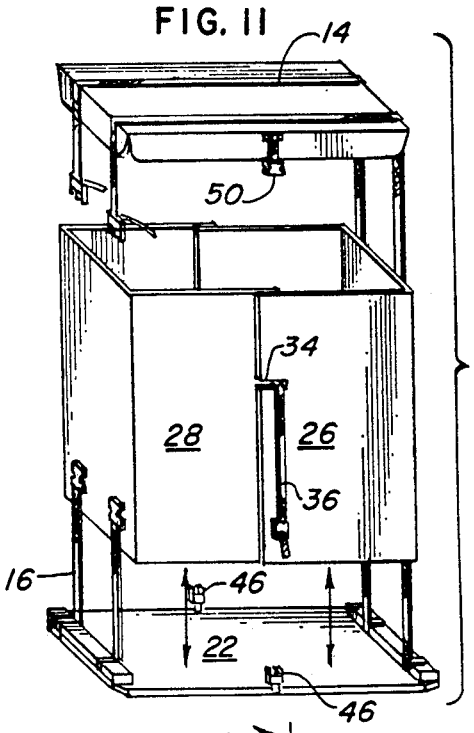
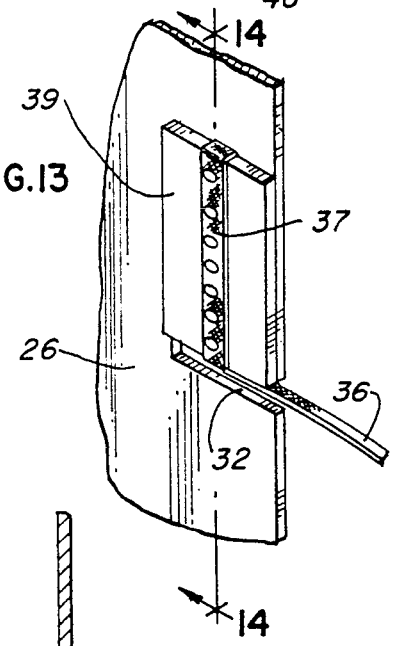
FIG. 13
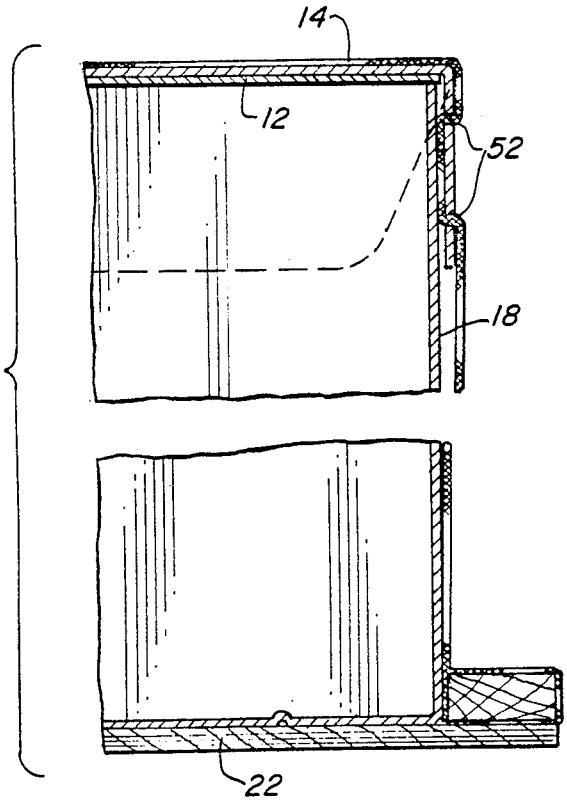
FIG. 12
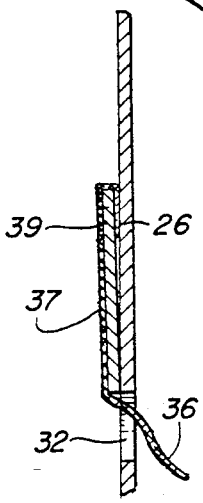
FIG. 14

FLAT STORABLE CONTAINER

BACKGROUND OF THE INVENTION

In the airline industry, passenger luggage and other cargo is typically stored in the large holds of airliners in movable containers which are typically made of aluminum. This prevents the undue shifting of cargo, and also permits the sorting of cargo by destination, and the like, as well as assuring that the small bags in the large airliner hold will not fly around in rough transit. Typically, these aluminum cargo containers may be preloaded and then placed into the hold of the airliner.

However, the use of such aluminum cargo containers causes the airliner to be dependent upon the supply of cargo containers found at the various airports that they visit. In the event of a shortage of such cargo containers, significant problems develop in the entire cargo handling operation.

In accordance with this invention, a foldable cargo container is provided. The cargo container of this invention is flat-storable, but can be quickly assembled into an unfolded, container-forming position, for use where permanent, aluminum cargo containers are unavailable or, if desired, in place of such permanent containers. The flat-storable cargo containers of this invention may be carried along in the airplane so that the airplane will never be without a supply of cargo containers for use in its own hold. Also, the container of this invention is lighter than a typical aluminum cargo container of equal size, for saving of weight.

When the container of this invention is not needed, it may be refolded down into its flat-stored configuration, to permit its convenient storage in the cargo hold of an airplane, or a boat, a warehouse, or anywhere else where such a container would be desired.

DESCRIPTION OF THE INVENTION

By this invention a flat-storable container is provided which comprises a bottom deck, and a pair of opposed sidewalls attached to the bottom deck in hinged relation, to permit the sidewalls to lie flat against the deck in a folded position, and alternatively to stand in perpendicular relation thereto in a container-forming position.

The sidewalls each carry a pair of foldable side flap means which are proportioned to be unfolded in the container-forming position to define side flaps extending perpendicular to the previously named sidewalls. Preferably, the sidewalls each carry a pair of opposed, foldable side flaps which are proportioned to be unfolded in the container-performing position, to preferably each engage a side flap of the opposed sidewall, whereby sets of the engaging side flaps define lateral container walls extending between ends of the opposed sidewalls. Thus, the sidewalls and side flaps define, with the deck, an open-top, rectangular container in the container-forming position. Alternatively, a single side flap may form the entire lateral container wall.

A container lid is also provided, along with strap means for holding the lid on the container and for holding the engaging side flaps together.

Typically, the bottom deck may be a plywood rectangle having a length of at least about five feet and a width of at least about four feet. For example, in one preferred embodiment the deck may be a rectangle of 60 by 69 inches. In another embodiment, the dimensions of the plywood deck may be 60 by 60.4 inches, or 60.4 by 96 inches. Other dimensions may of course be used as desired. Thus, a good-sized storage container may be provided, which folds flat in the storage position when that is desired.

The height of the container in its container-forming position is typically at least four feet. The sidewalls and side flaps may be made of corrugated cardboard or plastic, having one edge attached to the deck in a manner to permit the sidewalls and side flaps to be folded together and then pivoted down into flat, parallel relation with the deck for storage.

The strap means for holding the lid on the container may comprise a strap extending the entire width of the lid, and extending through slots on opposed sides of the lid for connection at both strap ends with side flap retaining straps.

Side flap retaining straps may be positioned to extend through slots which are defined in each side flap, each slot of each side flap being positioned in registry with the slot of the engaging side flap in the container-forming position, whereby the side flaps are held in engaging relation by the side flap retaining strap.

The container may also have opposed strap connectors secured to opposite sides of the bottom deck, for connection with the strap ends of the strap attached to the lid in the folded, flat-stored configuration of the container.

Also, it is preferred for a pair of straps to extend from opposed attachment points on the deck, up the opposed side flaps and along the lid, joining to form an inverted, U-shaped retaining strap for the lid in the container-forming position.

Thus, the container of this invention can be relatively large, yet it can be easily moved by one or two men to a desired position in its flat-stored configuration. Then, the container may be unfolded and secured, typically by straps, into its container-forming position. The container may then be filled with the contents such as luggage, and secured with a lid and continuous sidewalls to retain the luggage in a manner that is as effective as a permanent, metal container of similar size.

DESCRIPTION OF THE DRAWINGS

FIG. 10 is a perspective view showing how one or more of the side flaps of the container may be opened for access, to load and unload the contents of the container;

FIG. 11 is an exploded, perspective view of the assembled container;

FIG. 12 is a sectional view taken along line 12—12 of FIG. 10;

FIG. 13 is a fragmentary perspective view of a side flap and attached strap; and FIG. 14 is a sectional view taken along line 14—14 of FIG. 13.

DESCRIPTION OF SPECIFIC EMBODIMENT

Figure 1:
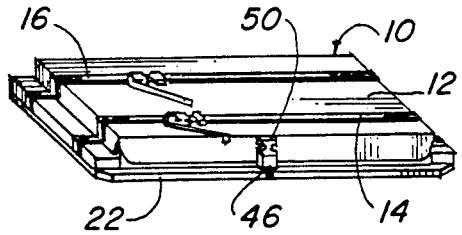
FIG. 1 is a perspective view of one embodiment of the container of this invention in its folded, flat-stored configuration.

Referring to the drawings, FIG. 1 discloses a flat storable container 10 of this invention in its folded, flat-stored position, being covered by lid 12 and secured along its length by straps 14, 16.

Figure 2:
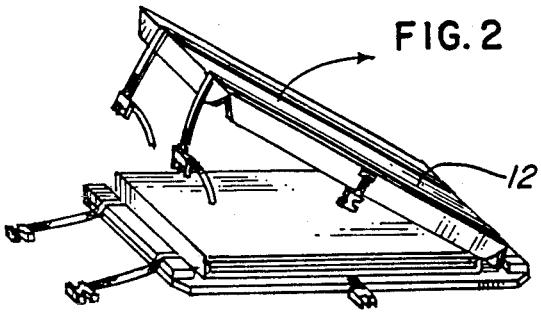
FIG. 2 is a perspective view showing how the lid of the container may be separated from the remainder thereof as a first step of opening.

FIG. 2 shows how straps 14, 16 may be released, and lid 12 removed from the remainder of flat-stored container 10.

Figure 3:
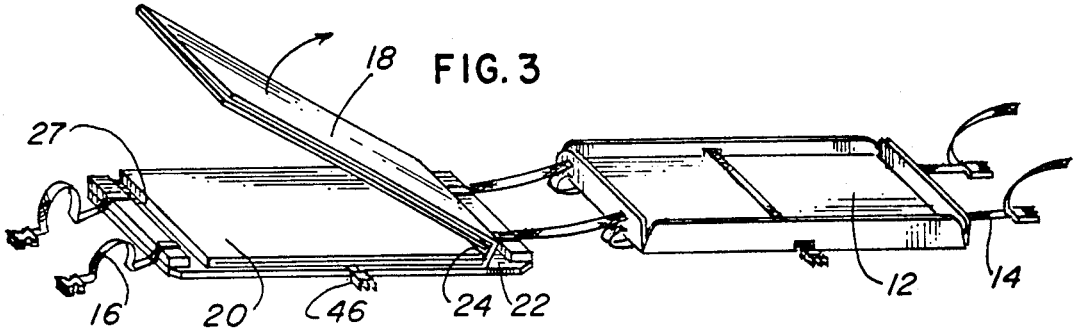
FIGS. 3 through 7 are perspective views showing sequential steps in the upward pivoting and unfolding of the sidewalls and side flaps, to define the side and lateral walls of the container in its container-forming position.
Figure 4:
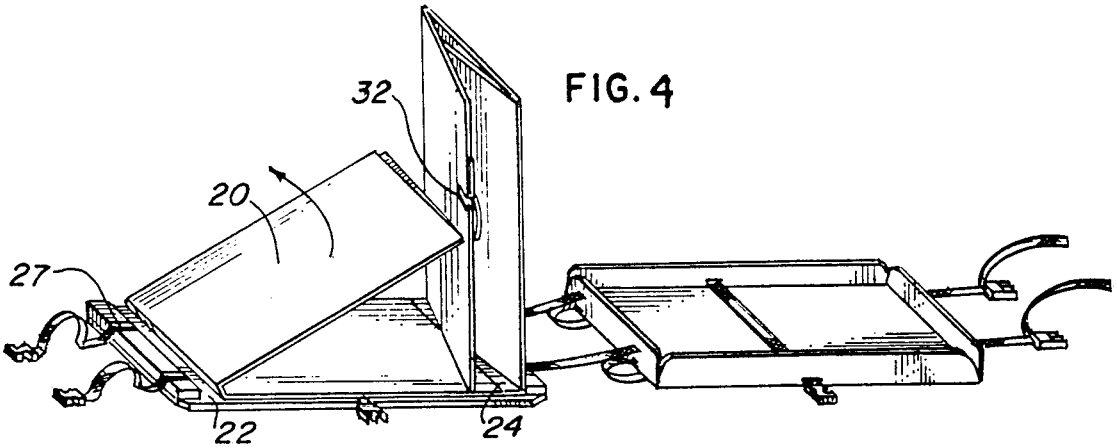

FIG. 3 shows how a first opposed sidewall 18 may be pivoted upwardly, followed in FIG. 4 by the upward pivoting of second sidewall 20. Sidewalls 18, 20 may be secured at one end to a plywood deck 22, respectively along fold lines 24, 27. This may be accomplished by gluing a portion of sidewalls 18, 20 to the deck and defining a fold line 24, 27 in the sidewall material, which may be made of corrugated cardboard. Fold lines 24, 27 may be closely spaced, double fold lines to facilitate folding of the sidewalls with less stress.

Figure 5:
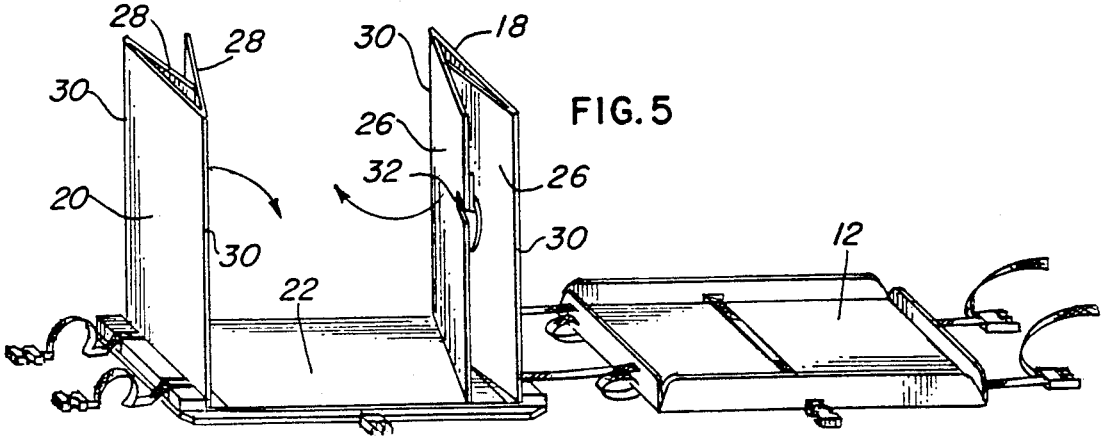
Figure 6:
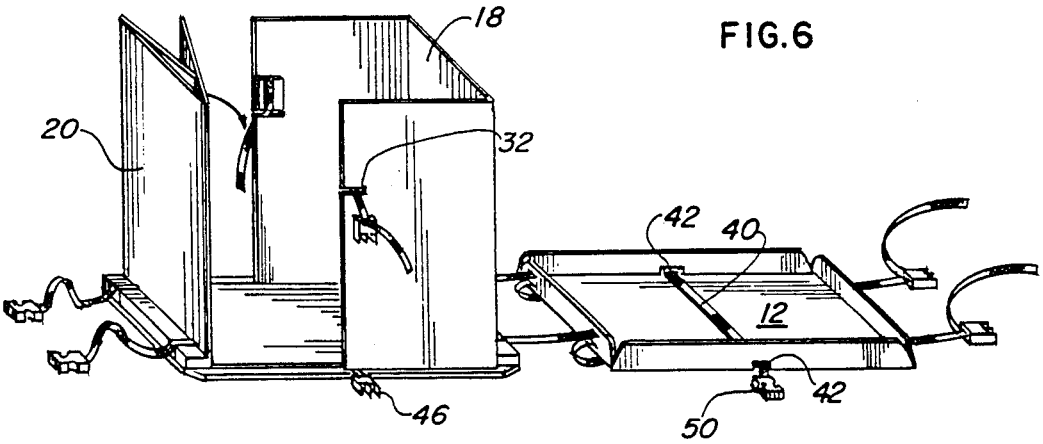

Following this, in FIG. 5, sidewalls 18, 20 are each shown to carry a pair of opposed, foldable side flaps 26, 28 which are an integral part of the corrugated cardboard of the respective sidewalls 18, 20, being connected thereto along pivot lines 30 formed in the corrugated cardboard material. Thus, side flaps 26, 28 can fold outwardly to define a lateral wall of container 10, as particularly shown in FIGS. 6 and 7, with the lateral walls overlapping as shown therein. Also, each of overlapping walls 26, 28 defines a slot 32, 34, which slots 32, 34 are positioned in registry with each other when side flaps 26, 28 are in the container-forming configuration of FIG. 7.

Figure 8:
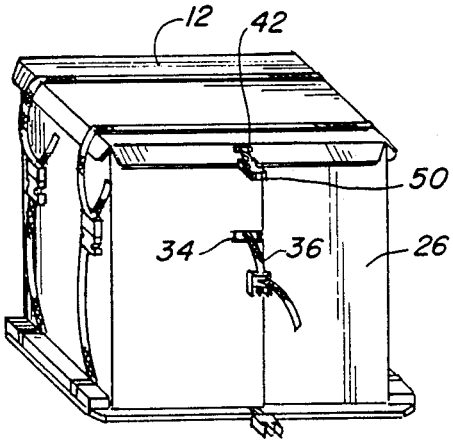
FIGS. 8 and 9 are perspective views showing how the top is applied and the container strapped together in the container-forming position.
Figure 9:
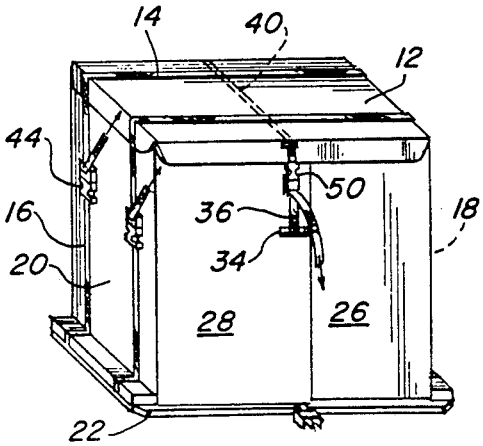

As shown in FIGS. 8–14, each side flap 26 defines a strap 36 which is attached with a loop end 37 to a reinforced portion 39 of side flap 26, and which projects out of slot 32. Strap 36 may then be projected through slot 34 of side flap 28 to serve as a means for securing the side flaps together by latching with connector 50, as shown in FIGS. 8 and 9.

Figure 7:
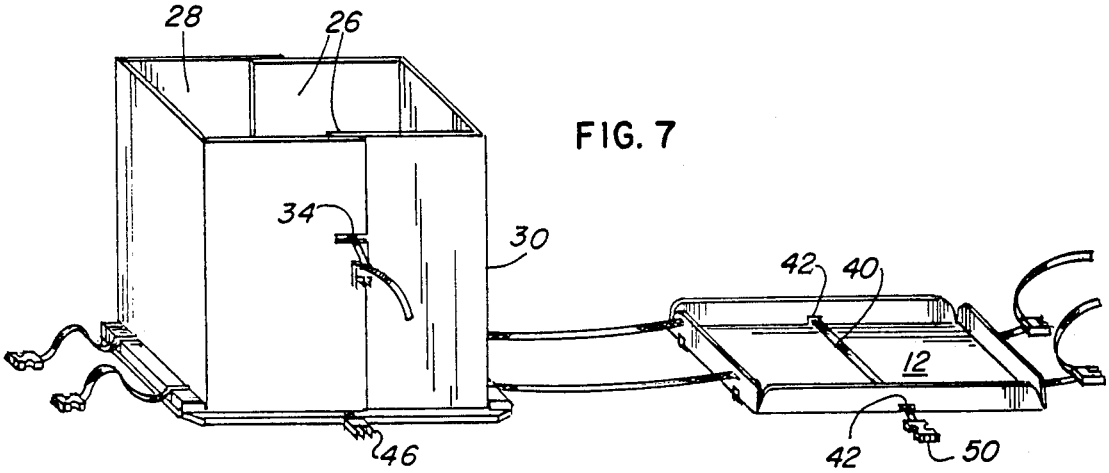

Container 10 in FIG. 7 is shown in its container-forming position to define an open-top, rectangular container. Then, lid 12 may be placed on the container as in FIG. 8, and the various straps secured as shown in FIG. 9. Strap 36 extends upwardly to connect through connector 50 and strap 40, which is secured by extending through slots 42 on both sides of lid 12, so that each end of strap 40 is linked with conventional strap connector 50 to form a tension connection with the respective straps 36 on both sides. Thus, lid 12 is held down from the lateral perspective in a manner identical at both sides.

Then, straps 14, 16, which are each connected to deck 22, may be brought up the sidewalls 18, 20 and over lid 12 into conventional, tight, strap connection 44 to form a strap securance in the shape of an inverted U, for further holding of the container together and lid 12 thereon. Straps 14 pass through double slots 52 of lid 12 to help retain the lid with the rest of the container.

Thus, the container of this invention, filled with luggage or any other cargo, serves as a suitable storage container as a substitute for metal equivalents of similar size. FIG. 10 shows how flaps 26, 28 may be opened for loading and unloading.

When it is desired to refold the container, the various steps of refolding may be done in substantially the reverse order of that previously described herein in FIGS. 1–9, to once again convert the container to its configuration of FIG. 1. In this configuration, strap 40, carried transversely through two slots 42 in lid 12, may connect at its end with a connector 46, each of which are carried on deck 22 at the periphery thereof in opposed relation. Straps 14 and 16 may be resecured as well, to hold container 10 in its folded, flat-stored configuration, where it may be conveniently stowed in the baggage compartment of a large airplane or elsewhere until its use is again needed.

The above has been offered for illustrative purposes only, and is not intended to limit the scope of the invention of this application, which is as defined in the claims below.

That which is claimed is:

1. A flat-storable container which comprises a bottom deck; a pair of opposed sidewalls positioned on said bottom deck to permit said sidewalls to lie flat against the deck in a folded position, and to stand in perpendicular relation thereto in a container-forming position; said sidewalls each carrying a pair of opposed, foldable side flaps which are proportioned to be unfolded into the container-forming position to each engage the side flap of the opposed sidewall, wherein sets of said engaging side flaps define lateral container walls extending between ends of said opposed sidewalls, to define with said deck an open-top, rectangular container; a container lid; and means for holding said lid on the container and for holding said engaging side flaps together, said means for holding said lid on the container comprising a strap carried by said lid and having opposed ends, said strap extending under said lid over the entire width of said lid and extending through first slots on opposed sides of said lid for connection at said strap ends outside of said lid with side flap retaining straps when the sidewalls are in said container-forming position.

2. The container of claim 1 in which said bottom deck is a rectangle having a length of at least about 5 feet and a width of at least about 4 feet.

3. The container of claim 1 having a height in said container-forming position of at least 4 feet.

4. The container of claim 1 in which said bottom deck is made of plywood.

5. The container of claim 4 in which said sidewalls and side flaps are made of material selected from the group consisting of corrugated cardboard and plastic.

6. The container of claim 1 having opposed strap connectors secured to opposed sides of said bottom deck and connecting with said opposed strap ends carried by said lid in said folded position.

7. The container of claim 1 in which said side flap retaining straps are positioned to extend through second slots which are defined in each side flap, each of said second slots being positioned in registry with the second slot of the engaging side flap in the container-forming position, whereby said side flaps are held in engaging relation by said side flap retaining straps.

8. The container of claim 1 in which a pair of added lid retaining straps each extend from opposed attachment points on said deck, up said sidewalls, and along said lid, joining to form an inverted, U-shaped retaining strap member for said lid in the container-forming position.

9. A flat-storable container which comprises a bottom deck; a pair of opposed sidewalls positioned on said bottom deck to permit said sidewalls to lie flat against the deck in a folded position, and to stand in perpendicular relation thereto in a container-forming position; said sidewalls each carrying a pair of opposed, foldable side flaps which are proportioned to be unfolded in the container-forming position to each engage the side flap of the opposed sidewall, wherein sets of said engaging side flaps define lateral container walls extending between ends of said opposed sidewalls to define with said deck an open-top, rectangular container; a container lid; and means for holding said lid on the container and for holding said engaging side flaps together, said means for holding comprising a strap having opposed ends extending the entire width of said lid and extending through first slots on opposed sides of said lid, for connection at said strap ends with side flap retaining straps, said side flap retaining straps being positioned to extend through second slots which are defined in each side flap, each of said second slots being positioned to be in registry with the second slot of the engaging side flap in the container-forming position, wherein said side flaps are held in engaging relation by said side flap retaining straps.

10. The container of claim 9 in which a pair of added retaining straps each extend from opposed attachment points on said deck, up said sidewalls, and along said lid, joining to form an inverted U-shaped retaining strap member for said lid in the container-forming position.

11. The container of claim 10 having opposed strap connectors secured to opposed sides of said bottom deck, for connection with said strap ends carried by said lid in said folded configuration.

12. The container of claim 11 in which said bottom deck is a rectangle having a length of at least about 5 feet, a width of at least about 4 feet, and a height of at least about 4 feet in said container-forming position.

13. The container of claim 11 in which said bottom deck is made of plywood and said sidewalls and side flaps are made of material selected from the group consisting of corrugated cardboard and plastic.

14. A flat-storable container which comprises a bottom deck; a pair of opposed sidewalls attached to said bottom deck in hinged relation thereto to permit said sidewalls to lie flat against the deck in a folded position, and to stand in perpendicular relation thereto in a container-forming position; said sidewalls each carrying a pair of opposed, foldable side flaps which are proportioned to be unfolded into the container-forming position to each engage the side flap of the opposed sidewall, wherein sets of said engaging side flaps define lateral container walls extending between ends of said opposed sidewalls, to define with said deck an open-top, rectangular container; a container lid; and means for holding said lid on the container and for holding said engaging side flaps together, said means for holding said lid on the container comprising a strap carried by said lid and having opposed ends, said strap extending the entire width of said lid and extending through first slots on opposed sides of said lid for connection at said strap ends with side flap retaining straps, said side flap retaining straps being positioned to extend through second slots which are defined in each side flap, each of said second slots being positioned in registry with the second slot of the engaging side flap in the container-forming position, wherein said side flaps are held in engaging relation by said side flap retaining straps.

15. The container of claim 14 in which a pair of added lid retaining straps each extend from opposed attachment points on said deck, up said sidewalls and along said lid, joining to form an inverted, U-shaped retaining strap member for said lid in the container-forming position.

16. The container of claim 15 in which said bottom deck is a rectangle having a length of at least about five feet and a width of at least about four feet, said container having a height in said container-forming position of at least about four feet.

* * * * *